US006430974B1

(12) United States Patent
Mitchell et al.

(10) Patent No.: US 6,430,974 B1
(45) Date of Patent: Aug. 13, 2002

(54) STRAP AND LOCK ASSEMBLY FOR LUGGAGE

(76) Inventors: Tommie L. Mitchell; Juanita Mitchell, both of 8015 S. Artesian St., Chicago, IL (US) 60652

( * ) Notice: Subject to any disclaimer, the term of this patent is extended or adjusted under 35 U.S.C. 154(b) by 0 days.

(21) Appl. No.: 09/747,898

(22) Filed: Dec. 26, 2000

(51) Int. Cl.[7] ..... E05B 65/52

(52) U.S. Cl. ..... 70/18; 70/64; 70/69; 70/164; 24/167; 190/120

(58) Field of Search ..... 70/18, 58, 64, 70/69, 2, 14, 164; 24/166, 167; 190/26, 27, 101, 119, 120

(56) References Cited

U.S. PATENT DOCUMENTS

| | | | | |
|---|---|---|---|---|
| 680,296 | A | 8/1901 | Vandervoort | |
| 902,695 | A | 11/1908 | Staley | |
| 3,748,876 | A | 7/1973 | Mathews | 70/18 |
| D257,426 | S | 10/1980 | D'alo | D9/99 |
| 4,700,818 | A | 10/1987 | Orwin | 190/27 |
| 5,510,768 | A | 4/1996 | Mann | 340/571 |

*Primary Examiner*—Lloyd A. Gall

(57) ABSTRACT

A strap and lock assembly for luggage for preventing luggage from breaking open. The strap and lock assembly for luggage includes a strap assembly including an elastic strap member being adapted to wrap about a piece of luggage; and also includes ring assemblies including ring members being securely attached to ends of the elastic strap member; and further includes a hook member being securely attached to one of the ring members and being adapted to removably engage about the other of the ring members; and also includes a padlock member for locking the elastic strap member about the piece of luggage.

12 Claims, 4 Drawing Sheets

STRAP AND LOCK ASSEMBLY FOR LUGGAGE

BACKGROUND OF THE INVENTION

1. Field of the Invention

The present invention relates to a luggage belt and lock and more particularly pertains to a new strap and lock assembly for luggage for preventing luggage from breaking open.

2. Description of the Prior Art

The use of a luggage belt and lock is known in the prior art. More specifically, a luggage belt and lock heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,700,818; 5,510,768; 902,695; 680,296; 3,748,876; and U.S. Pat. No. Des. 257,426.

While these devices fulfill their respective, particular objectives and requirements, the aforementioned patents do not disclose a new strap and lock assembly for luggage. The inventive device includes a strap assembly including an elastic strap member being adapted to wrap about a piece of luggage; and also includes ring assemblies including ring members being securely attached to ends of the elastic strap member; and further includes a hook member being securely attached to one of the ring members and being adapted to removably engage about the other of the ring members; and also includes a padlock member for locking the elastic strap member about the piece of luggage.

In these respects, the strap and lock assembly for luggage according to the present invention substantially departs from the conventional concepts and designs of the prior art, and in so doing provides an apparatus primarily developed for the purpose of preventing luggage from breaking open.

SUMMARY OF THE INVENTION

In view of the foregoing disadvantages inherent in the known types of luggage belt and lock now present in the prior art, the present invention provides a new strap and lock assembly for luggage construction wherein the same can be utilized for preventing luggage from breaking open.

The general purpose of the present invention, which will be described subsequently in greater detail, is to provide a new strap and lock assembly for luggage which has many of the advantages of the luggage belt and lock mentioned heretofore and many novel features that result in a new strap and lock assembly for luggage which is not anticipated, rendered obvious, suggested, or even implied by any of the prior art luggage belt and lock, either alone or in any combination thereof.

To attain this, the present invention generally comprises a strap assembly including an elastic strap member being adapted to wrap about a piece of luggage; and also includes ring assemblies including ring members being securely attached to ends of the elastic strap member; and further includes a hook member being securely attached to one of the ring members and being adapted to removably engage about the other of the ring members; and also includes a padlock member for locking the elastic strap member about the piece of luggage.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new strap and lock assembly for luggage which has many of the advantages of the luggage belt and lock mentioned heretofore and many novel features that result in a new strap and lock assembly for luggage which is not anticipated, rendered obvious, suggested, or even implied by any of the prior art luggage belt and lock, either alone or in any combination thereof.

It is another object of the present invention to provide a new strap and lock assembly for luggage which may be easily and efficiently manufactured and marketed.

It is a further object of the present invention to provide a new strap and lock assembly for luggage which is of a durable and reliable construction.

An even further object of the present invention is to provide a new strap and lock assembly for luggage which is susceptible of a low cost of manufacture with regard to both materials and labor, and which accordingly is then susceptible of low prices of sale to the consuming public, thereby making such strap and lock assembly for luggage economically available to the buying public.

Still yet another object of the present invention is to provide a new strap and lock assembly for luggage which provides in the apparatuses and methods of the prior art some of the advantages thereof, while simultaneously overcoming some of the disadvantages normally associated therewith.

Still another object of the present invention is to provide a new strap and lock assembly for luggage for preventing luggage from breaking open.

Yet another object of the present invention is to provide a new strap and lock assembly for luggage which includes a strap assembly including an elastic strap member being adapted to wrap about a piece of luggage; and also includes ring assemblies including ring members being securely attached to ends of the elastic strap member; and further includes a hook member being securely attached to one of the ring members and being adapted to removably engage about the other of the ring members; and also includes a padlock member for locking the elastic strap member about the piece of luggage.

Still yet another object of the present invention is to provide a new strap and lock assembly for luggage that can be easily and quickly wrapped and locked about one's luggage.

Even still another object of the present invention is to provide a new strap and lock assembly for luggage that prevents valuables from being stolen from one's luggage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
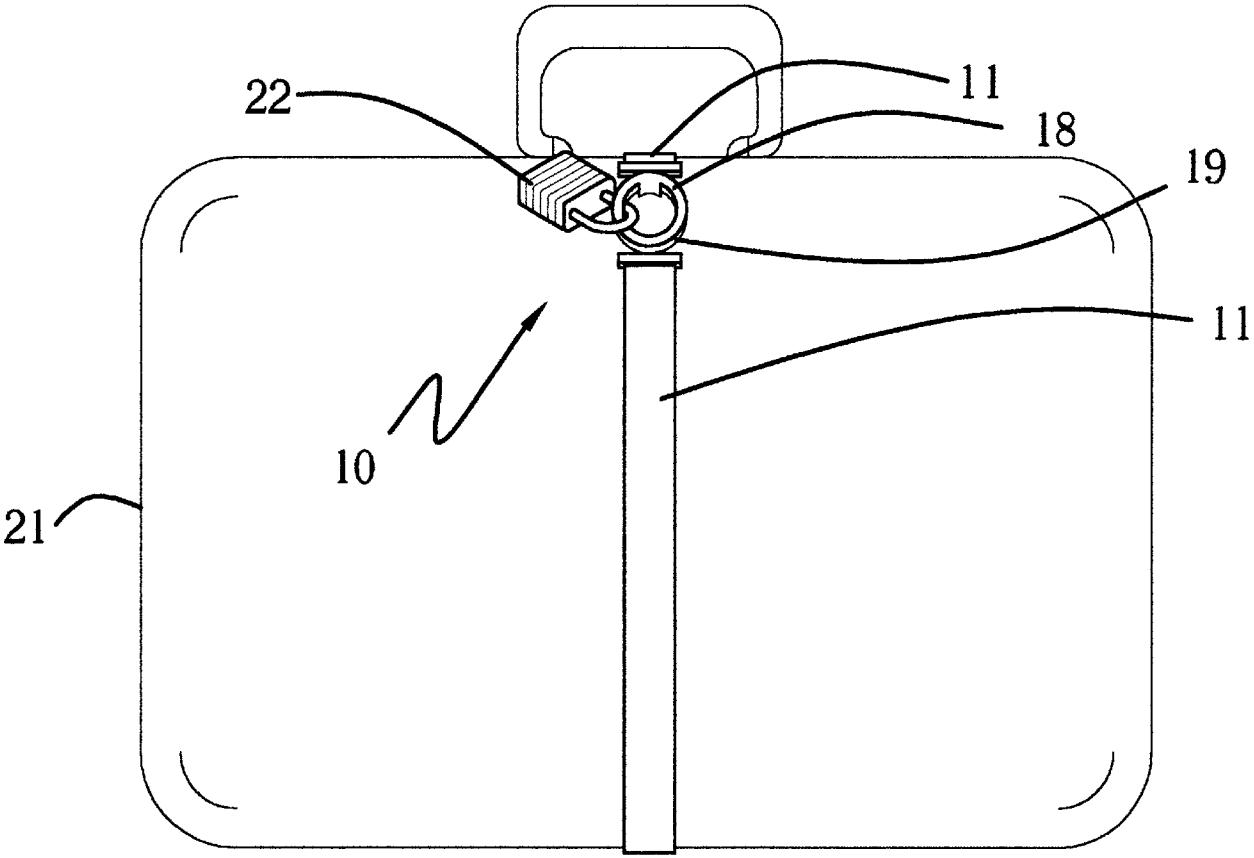
FIG. 1 is a perspective view of a new strap and lock assembly for luggage according to the present invention.
Figure 2:
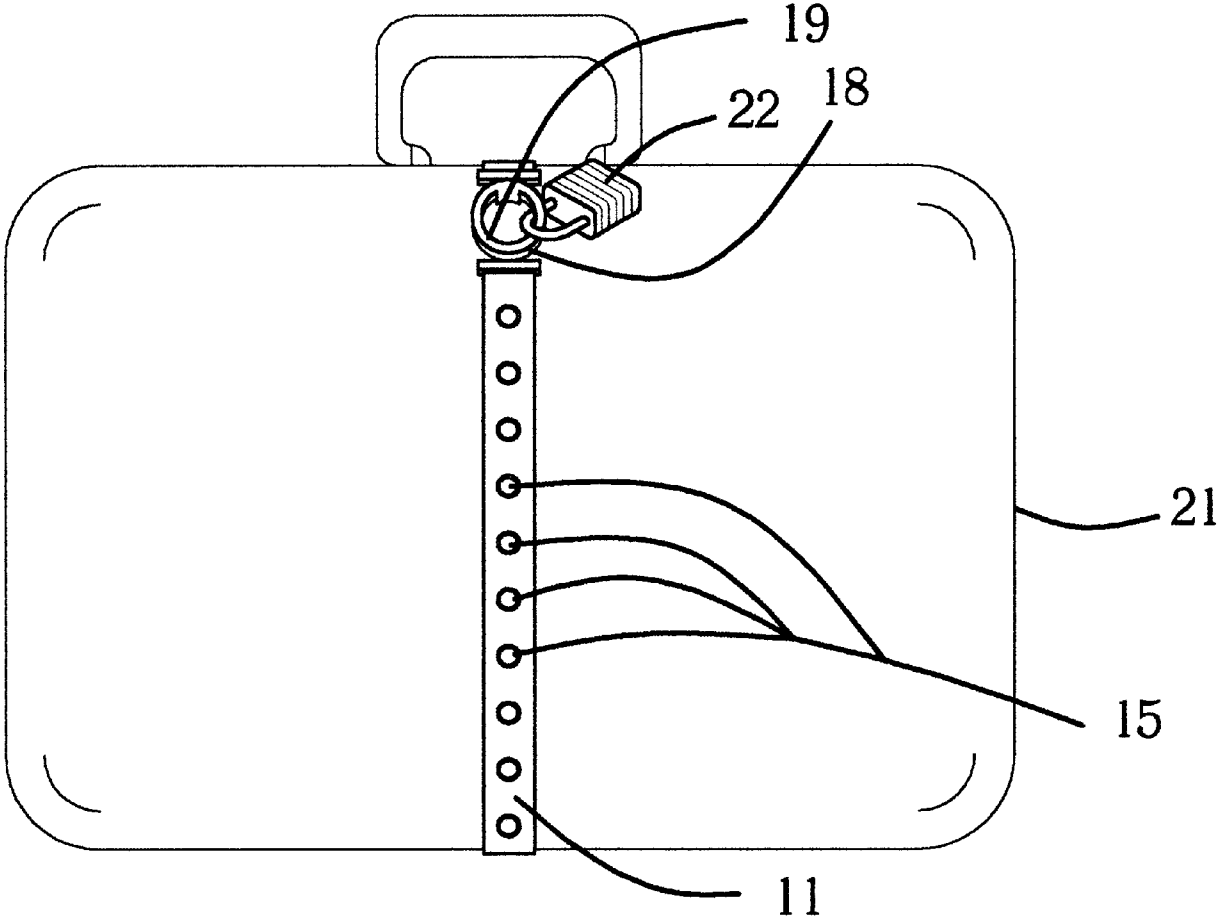
FIG. 2 is another perspective view of the present invention.
Figure 3:
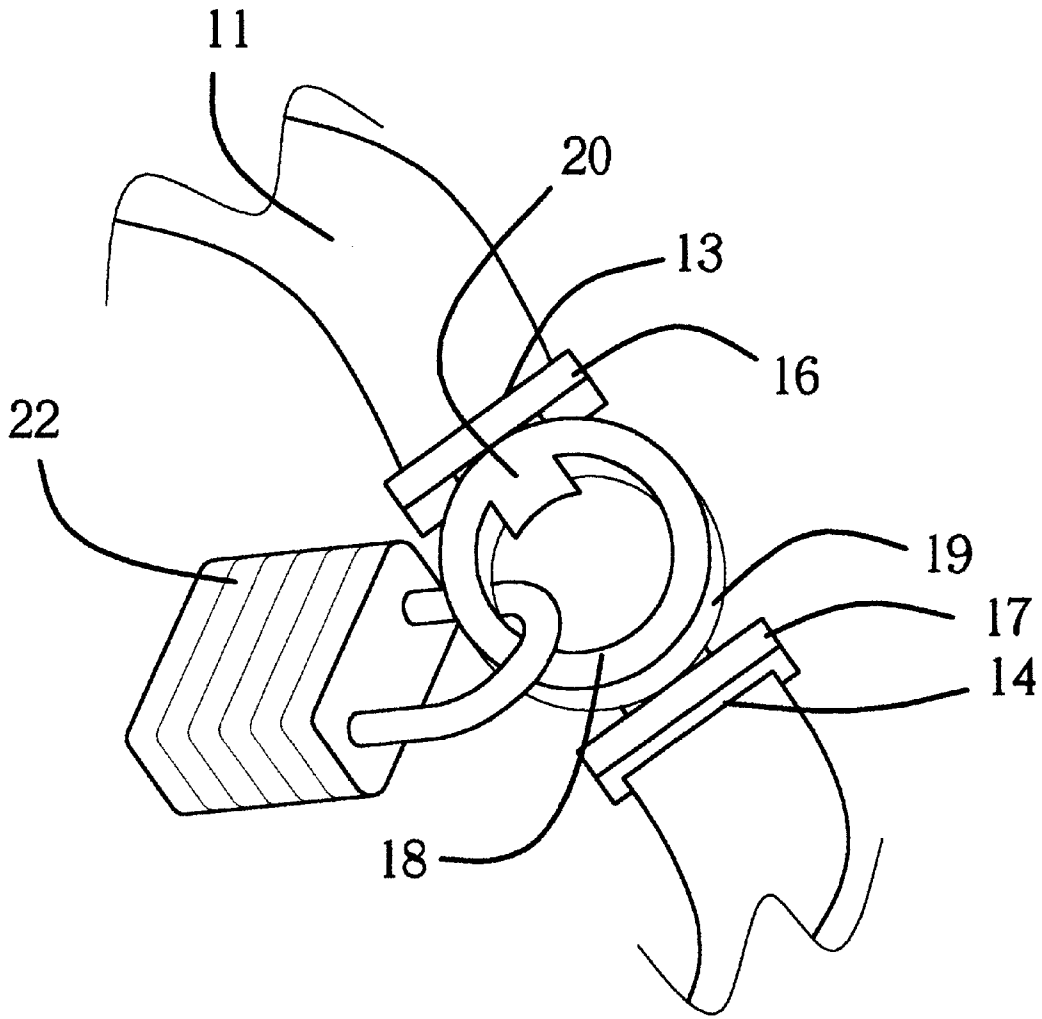
FIG. 3 is a detailed perspective view of the ring members of the present invention.
Figure 4:
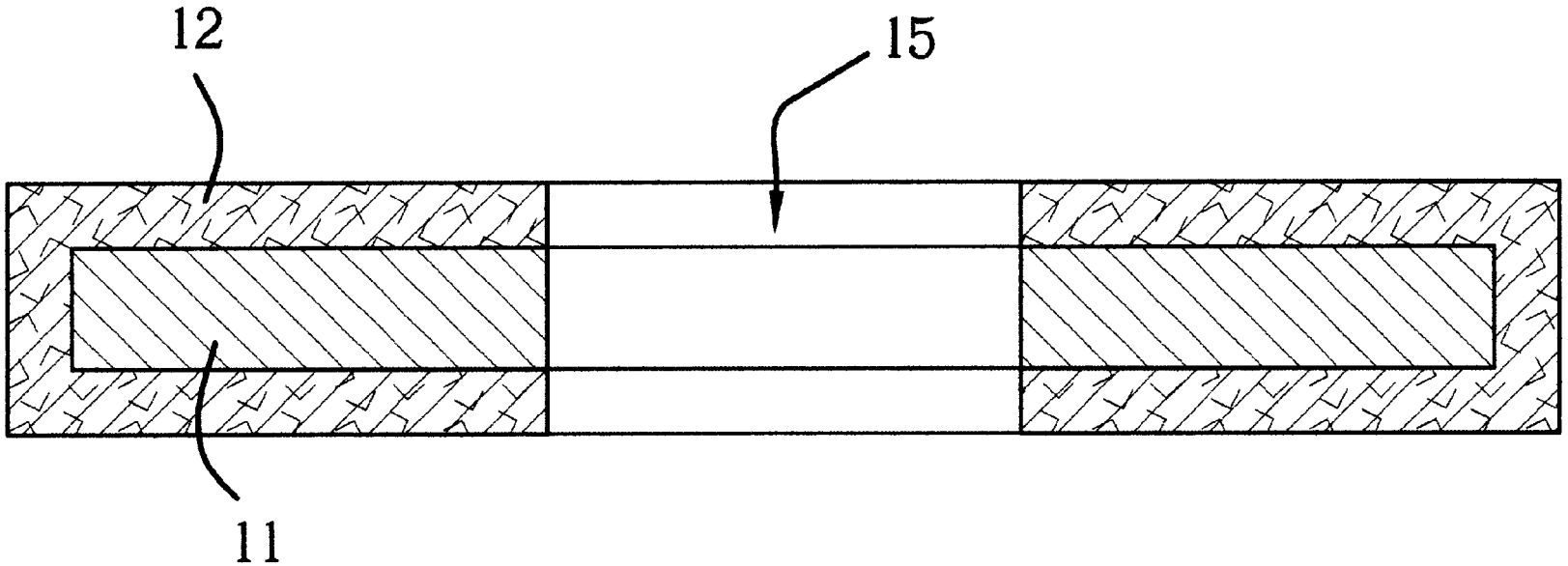
FIG. 4 cross-sectional view of the strap assembly of the present invention.

With reference now to the drawings, and in particular to FIGS. 1 through 4 thereof, a new strap and lock assembly for luggage embodying the principles and concepts of the present invention and generally designated by the reference numeral 10 will be described.

As best illustrated in FIGS. 1 through 4, the strap and lock assembly for luggage 10 generally comprises a strap assembly including an elastic strap member 11 being adapted to wrap about a piece of luggage 21. The strap assembly also includes a cover 12 being enclosed about the elastic strap member 11. The elastic strap member 11 includes a plurality of holes 15 being spaced along and being disposed through a portion of the elastic strap member 11 to adjust the elastic strap member 11 to fit different sizes of luggage 21.

Ring assemblies include ring members 18,19 being securely and conventionally attached to ends 13,14 of the elastic strap member 15. The ring assemblies further include ring support members 16,17 which are securely and conventionally attached at the ends 13,14 of the elastic strap member 11. Each of the ring members 18,19 is securely and conventionally attached and welded to a respective one of the ring support members 16,17. Each of the ring support members 16,17 is generally a stub bar member which has a longitudinal side that is securely and conventionally attached to a respective end 13,14 of the elastic strap member 11.

A hook member 20 is securely and conventionally attached and welded to one of the ring members 18,19 and is adapted to removably engage about the other of the ring members 18,19. The hook member 20 is securely attached to an inner side of the ring member 18,19. A padlock member 22 for locking the elastic strap member about the piece of luggage is adapted to lock about the ring members 18,19 and is adapted to extend through the holes 15 of the elastic strap member 11.

In use, the user closes the piece of luggage 21 and tightly extends the elastic strap member 11 about the luggage 21 and secures the elastic strap member 11 about the luggage 21 with the padlock member 22 which is fastened about the ring members 18,19 and/or about the holes 15.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A strap and lock assembly for luggage comprising:

a strap assembly including an elastic strap member being adapted to wrap about a piece of luggage;

ring assemblies including ring members being securely attached to ends of said elastic strap member;

a hook member being securely attached to one of said ring members and being adapted to removably engage about the other of said ring members; and a padlock member for locking said elastic strap member about the piece of luggage;

wherein said ring assemblies further includes ring support members which are securely attached at said ends of said elastic strap member, each of said ring members being securely attached to a respective one of said ring support members; and wherein each of said ring support members is generally a stub bar member which has a longitudinal side that is securely attached to a respective said end of said elastic strap member.

2. A strap and lock assembly for luggage as described in claim 1, wherein said strap assembly includes a cover being enclosed about said elastic strap member.

3. A strap and lock assembly for luggage as described in claim 2, wherein said elastic strap member includes a plurality of holes being spaced along and being disposed through a portion of said elastic strap member to adjust said elastic strap member to fit different sizes of luggage.

4. A strap and lock assembly for luggage as described in claim 1, wherein said hook member is securely attached to an inner side of said ring member.

5. A strap and lock assembly for luggage as described in claim 4, wherein said padlock member is adapted to lock about said ring members and is adapted to extend through a hole of said elastic strap member.

6. A strap and lock assembly for luggage comprising:

a strap assembly including an elastic strap member being adapted to wrap about a piece of luggage, said strap assembly including a cover being enclosed about said elastic strap member, said elastic strap member including a plurality of holes being spaced along and being disposed through a portion of said elastic strap member to adjust said elastic strap member to fit different sizes of luggage;

ring assemblies including ring members being securely attached to ends of said elastic strap member, said ring assemblies further including ring support members which are securely attached at said ends of said elastic strap member, each of said ring members being securely attached to a respective one of said ring support members, each of said ring support members being generally a stub bar member which has a longitudinal side that is securely attached to a respective said end of said elastic strap member;

a hook member being securely attached to one of said ring members and being adapted to removably engage about the other of said ring members, said hook member being securely attached to an inner side of said ring member; and a padlock member for locking said elastic strap member about the piece of luggage, said padlock member being adapted to lock about said ring members and being adapted to extend through said holes of said elastic strap member.

7. A luggage locking system comprising:

luggage having a pair of shell portions pivotally mounted together in a manner forming a clam shell structure and a handle mounted on one of said shell portions at a pair of spaced locations to define a closed loop with said shell portion;

a strap assembly including a strap member having ends and being removably wrapped about the shell portions of said luggage and extending through said closed loop;

ring assemblies including ring members each being attached to said ends of said strap member;

a hook member being attached to one of said ring members and being removably engaged about the other of said ring members; and a padlock member for locking said strap member about said luggage;

wherein said ring assemblies include ring support members attached at said ends of said strap member, each of said ring members being attached to a respective one of said ring support members.

8. A luggage locking system as described in claim 7, wherein each of said ring support members comprises a stub bar member which has a longitudinal side that is attached to a respective said end of said strap member.

9. A luggage locking system as described in claim 7, wherein said strap assembly includes a cover being enclosed about said strap member.

10. A luggage locking system as described in claim 9, wherein said strap member includes a plurality of holes being spaced along and being disposed through a portion of said strap member to adjust an effective length of said strap member to fit different sizes of luggage.

11. A luggage locking system as described in claim 7, wherein said hook member is attached to an inner side of said ring member.

12. A luggage locking system as described in claim 10, wherein said padlock member is removably locked about said ring members and removably extends through said holes of said strap member.

* * * * *